United States Patent [19]

Feess et al.

[11] 4,231,745

[45] Nov. 4, 1980

[54] PROCESS FOR PAD-DYEING AND PRINTING FABRICS MADE OF CELLULOSE AND/OR REGENERATED MODIFIED CELLULOSE AND OPTIONALLY POLYESTER FIBERS

[75] Inventors: Erich Feess, Hofheim; Friedrich Reinhardt, Neuenhain, both of Fed. Rep. of Germany

[73] Assignee: Hoechst Aktiengesellschaft, Frankfurt am Main, Fed. Rep. of Germany

[21] Appl. No.: 887,363

[22] Filed: Mar. 16, 1978

Related U.S. Application Data

[63] Continuation of Ser. No. 741,400, Nov. 12, 1976, abandoned.

[30] Foreign Application Priority Data

Aug. 20, 1976 [DE] Fed. Rep. of Germany ..... 2551432

[51] Int. Cl.[3] ..... D06P 3/82; D06P 3/54

[52] U.S. Cl. ..... 8/552; 8/519; 8/672; 8/558

[58] Field of Search ..... 8/21 C, 24, 18 A, 62, 8/92, 54.2, 51, 21 R, 22

[56] References Cited

U.S. PATENT DOCUMENTS

| | | | |
|---|---|---|---|
| 1,976,679 | 10/1934 | Fikentscher et al. | 8/92 |
| 3,706,525 | 12/1972 | Blackwell et al. | 8/21 C |
| 3,861,869 | 1/1975 | Schwindt et al. | 8/62 |
| 3,888,624 | 6/1975 | Blackwell et al. | 8/21 C |
| 3,940,247 | 2/1976 | Sthare et al. | 8/85 R |
| 4,049,377 | 9/1977 | Schwab et al. | 8/21 C |
| 4,095,942 | 1/1978 | Dellian et al. | 8/18 R |

FOREIGN PATENT DOCUMENTS

| | | |
|---|---|---|
| 243206 | 9/1960 | Australia . |
| 859671 | 4/1978 | Belgium . |
| 369915 | 3/1932 | United Kingdom . |
| 1209241 | 10/1970 | United Kingdom . |
| 1242784 | 8/1971 | United Kingdom . |
| 1410703 | 10/1975 | United Kingdom . |

OTHER PUBLICATIONS

Venkataraman, K., "The Chemistry of Synthetic Dyes," vol. VIII, (Academic Press), 1978, pp. 179–180.

*Primary Examiner*—A. Lionel Clingman
*Attorney, Agent, or Firm*—Curtis, Morris & Safford

[57] ABSTRACT

Synthetic polymers having carboxy groups are useful thickeners for printing pastes or pad-dyeing liquors containing disperse dyestuffs for the coloring of cellulose fibers which may be regenerated or their mixtures or mixtures of such fibers with polyester fibers.

14 Claims, No Drawings

PROCESS FOR PAD-DYEING AND PRINTING FABRICS MADE OF CELLULOSE AND/OR REGENERATED MODIFIED CELLULOSE AND OPTIONALLY POLYESTER FIBERS

This is a continuation, of application Ser. No. 741,400 filed Nov. 12, 1976, now abandoned.

The present invention relates to a process for pad-dyeing and printing fabrics made of cellulose and/or modified cellulose and optionally polyester fibers.

The simplest process for the preparation of prints on fabrics made of cellulosic and synthetic fibers is the widely used pigment printing. Its use eliminates the after-treatment operations after fixation including all their inherent problems which operations have to be performed in all the other processes. In the pigment print process used in the art, water-insoluble color pigments are fixed on the fiber by means of a synthetic resin film covering the individual fiber. Since the volume of the individual fibers is increased by the application of the synthetic resin and the fibers stiffen to a lower or higher degree depending on the nature of the resin, the fabric feel mostly becomes distinctly fuller, if not harder, so that the soft, flowing drape which is one of the typical and generally appreciated properties of textile fabrics, is spoiled. Moreover, the superficial fixation of the pigment on the fiber leads to blank spots already after subjecting it to abrasion for a relatively short period.

The addition of softeners (plasticizers) or the development of especially soft binder combinations has contributed to counteract the poor feel, mostly to the detriment of other properties (fastness to washing, etc).

The gasoline-emulsion-thickenings mainly used in pigment print are increasingly replaced by gasoline-free print pastes whose thickening components are solutions of long-chain polycarboxylic acids.

However, in pigment printing, these print pastes yield a still harder feel than the emulsion print pastes.

It was therefore desirable to exploit the advantages of the pigment printing for the printing effected with alternative classes of dyestuffs.

Now, it was found that fabrics made of—optionally modified—cellulose fibers and their mixtures with polyester fibers can be printed or pad-dyed with disperse dyestuffs when aqueous solutions or swellable dispersions of a synthetic polymer containing carboxy groups are added to the padding liquors or print pastes as thickeners. After the usual fixation by hot air, superheated steam, pressurized steam or a combination of these fixing procedures, the dyeings and prints so obtained need no further after-treatment.

In the scope of this invention, padding also includes slop-padding.

Brilliant, intense dyeings or prints were so obtained accompanied by a perfectly satisfactory feel of fabric, because the dyestuff is completely absorbed by the fiber with an utmost exploitation of the dyestuff and because the addition of resins acting as binders—otherwise usual in pigment printing—is here not necessary. Depending on the disperse dyestuff added the generally very electrolyte sensitive polymer solutions or dispersions are stable for several weeks.

It was found that the polymer additives according to the invention allow the dyeing or printing of cellulose fiber fabrics with disperse dyestuffs. Evidently, these polycarboxylic acid compounds exercise a similar influence on the cellulose fibers and the disperse dyestuffs as do the compounds described in German Offenlegungsschrift No. 18 11 796 (U.S. Pat. Nos. 3,706,525 and 3,888,624). But in the process of this invention, the use of the synthetic polymer eliminates the wet processing.

The color yields obtainable according to the invention can still be increased by adding to the printing pastes or padding liquors addition compounds of a low-molecular alkylene oxide, for example compounds having 4 to 40, preferably 10 to 20 ethylene oxide units, such as those described in German Offenlegungsschrift No. 18 11 796. The compounds of the formula $$R[(C_nH_{2n}O)_mH]_x$$

in which R is a hydrogen atom, an alkyl or alkenyl radical having up to 20 carbon atoms, a phenyl radical which may be substituted by alkyl radicals having up to 10 carbon atoms, or a group of the formula

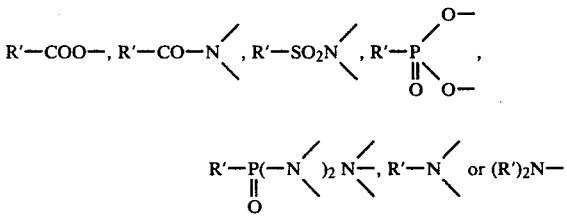

in which R' has the meaning given for R, n is a number of 2 to 3, m is a number of 1 to 40 and x is 1 to 3, provided that the product of m·x is 4 to 40, are preferred.

Especially preferred is the addition of 50 to 150 g per kg of printing paste of per 1 of padding liquor of a 10 to 20 times oxethylated bis-hydroxyalkyl phosphonate or the same amount of a 10 to 40 times oxethylated triethanol amine or the same amount of a 10 to 40 times oxethylated ortho-or para-toluenesulfonamide or the same amount of one of the polyglycol derivatives mentioned in German Offenlegungsschrift No. 18 11 796, above all polyethylene glycols having an average molecular weight of 400–1,000.

When one of the above-cited compounds increasing the color yield is combined with the thickener according to the invention in the printing paste, a print is obtained that shows even after a possible wet treatment—an indispensable condition in the use of conventional thickeners—for example soaping at the boil, a considerably better color yield than that obtained by the addition of the cited ethylene oxide compounds to printing pastes on the basis of usual thickeners, such as for example sodium alginate, locust bean flower ethers or an oxethylated cellulose. These facts are especially significant in the dyeing and printing of cellulose regenerate fibers which do not allow to obtain useful color depths with disperse dyestuffs using conventional thickeners even when adding the cited alkylene oxide compounds. When the thickeners of the invention are used, alkylene oxide derivatives need not be added to obtain dyeings or prints of high color intensity which are superior, even after a wet treatment for example at 90° C., to the color intensities obtainable by means of polyglycol-containing printing pastes with conventional thickeners.

The present invention is especially interesting for the dyeing or printing of blends of polyester and cellulose or cellulose regenerate fibers. Fabrics of this type can so readily be dyed by padding or printing onto them the padding or printing paste and subjecting the printed or padded fabric to a thermal treatment with hot air or overheated steam without an after-treatment in the wet state to follow. These operations yield intense and brilliant dyeings or sharply outlined prints having good fastness properties. The feel of the treated fabric is of equal quality at the printed and unprinted spots.

Because of the good dyestuff yield due to the specific thickening agents the fixing temperatures can be kept somewhat lower than with conventional thickeners.

Thickeners within the scope of the invention are: aqueous solutions or swellable dispersions of polymerized low molecular weight unsaturated mono or dicarboxylic acids having one ethylenically unsaturated bond, such as polyacrylic acid and its homologs, for example the polymerisation products of methacrylic acid or crotonic acid, and of the polymers of carboxyalkyl derivatives, such as itaconic acid or teraconic acid, as well as aqueous solutions or dispersions of polymerized maleic acid or its anhydride and fumaric acid and their homologs, such as citraconic acid or mesaconic acid and, furthermore, of copolymers with olefins, for example ethylene or propylene or lower acrylic acid alkyl esters and the said monomers containing carboxy groups.

The aqueous solutions or swellable dispersions of the cited synthetic polymers can be used as such, i.e. in the acid pH range, if they form usable thickenings or they can be converted into the corresponding salts by adding alkali or ammonia and be used in this form as thickener.

If necessary, and depending on the structure of the substrate to be printed, from 10 to 50 g of mineral oil or from 1 to 20 g of a softening compound, for example bis-(ethyl-hexyl)phthalate may be added per kg of printing paste.

The fixation of the dyestuffs and prints is effected in the usual manner by steaming at a pressure of from 1 to 2.5 (atmospheres over pressure) during 10 to 30 minutes or by a treatment during 30 seconds to 15 minutes in superheated steam or air of 150° to 220° C. or by the action of dry heat (radiation or contact heat).

It is known from British Pat. No. 1.242.784 that synthetic polymers containing carboxy groups which are derived from maleic anhydride or methacrylic acid, can be used as printing thickeners. However, it was not recognized that these polymers allowed the coloration of optionally modified cellulose fibers with disperse dyestuffs.

The viscosities named in the following Examples were determined by means of the Brookfield viscosimeter with 2% aqueous solutions at 25° C.

All indicated percentages are by weight unless stated otherwise.

EXAMPLE 1

A knitted fabric made of 65% endless polyethyleneglycol terephthalate fibers and 35% cotton fibers is printed with the following printing paste:

30 g of the powdered dyestuff of the formula

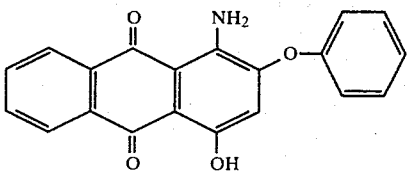

-continued 100 g (commercial form) are dispersed in of luke-warm water.

870 g The dispersion is introduced into of the aqueous 2% solution of an ammonium polyacrylate of the molecular weight 800.000.

1000 g

The printed fabric is dried and steamed during 20 minutes in a star steamer at 1.5 atmg. A pink brilliant shade is obtained. The printed fabric does not show any deterioration of feel. The abrasion fastness of the print is satisfactory.

EXAMPLE 2

A fabric made of 70% of poly-cyclohexanediol-terephthalate fibers and 30% of cotton fibers is padded on a padding mangle with a liquour containing per liter 20 g of the dyestuff of the formula

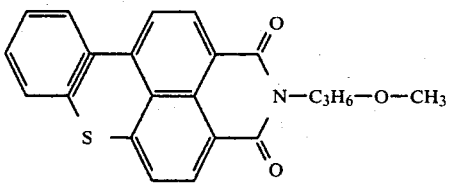

(commerical liquid form) and 200 g of the 1% aqueous solution of a copolymer of ethylene and maleic acid anhydride (molar ratio: 1:1, viscosity 85 P).

The padded fabric is squeezed off (70% liquor pick up), dried and is heated to 200° C. during 60 seconds on the hot air setting stenter. A brilliant yellow dyeing is obtained which has a pleasant feel and good fastness properties.

EXAMPLE 3

A fabric made of cellulose triacetate staple fibers is printed with the following printing paste:

50 g of the dyestuff of the formula

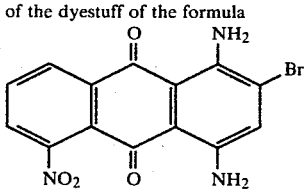

950 g (commercial liquid form) are introduced into of a 1.5% aqueous solution of an ammonium polyacrylate having the molecular weight 3,000,000.

1000 g

The printed fabric is dried and steamed with superheated steam at 180° C. during 5 minutes. A blue shade is obtained which has pleasant fastness properties. The feel of the fabric is satisfactory.

EXAMPLE 4

A cotton fabric is printed with the following printing paste:

40 g of the dyestuff of the formula

-continued

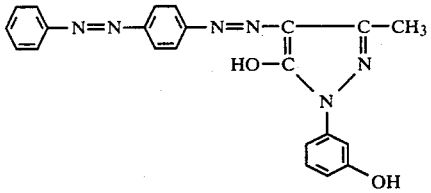

(commercial liquid form) is introduced into
960 g of a 1.5% aqueous solution of a copolymer of ethylene and maleic acid anhydride (molar ratio: 2:1; viscosity 80 P) while stirring.
1000 g The printed fabric is dried and heated to 200° C. for 1 minute on the hot air setting stenter. A reddish yellow print is obtained having good fastness properties. The feel of the fabric is perfectly satisfactory.

EXAMPLE 5

A spun rayon knitted fabric is padded with a padding liquor which contains per liter 30 g of the dyestuff of the formula

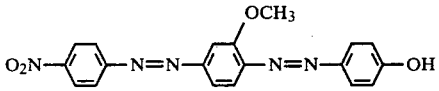

(commerical liquid form) and 5 g of a mixture of 65% of a polyacrylic acid (molar weight 1,000,000) and 35% of a copolymer of ethylene and maleic acid anhydride (molar ratio: 3:1, viscosity 70 P) and 100 g of polyethylene glycol of the molecular weight 600.

The padded fabric (liquor pick-up 100%) is dried and heated to 210° C. for 1 minute in a condensation apparatus.

A brown dyeing is obtained having usable fastness properties and a pleasant feel.

EXAMPLE 6

A fabric made of highly water-resistant regenerate cellulose fibers ("Modal" fibers) is printed with the following printing paste:

100 g of the dyestuff of the formula

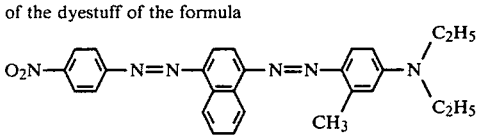

(commercial liquid form) are introduced with stirring into
780 g of a 2.5% aqueous solution of a copolymer of acrylic acid and acrylic acid butyl ester (molar ratio 4:1; molecular weight 600,000) adjusted with ammonia to weakly alkaline.
120 g of bis-polyhydroxyethyl octane-phosphonate (having 5 ethylene-oxide units in total) are added to the solution.
1000 g The printed fabric is dried and heated to 200° C. for 1 minute on the hot air setting stenter.

A navy blue shade is obtained which has satisfactory fastness properties and a perfectly satisfactory feel.

EXAMPLE 7

A fabric consisting in wharp and weft of a blended yarn containing 65% of polyethyleneglycol terephthalate fibers and 35% of cotton fibers is padded with a padding liquor which contains per liter 70 g of the dyestuff of the formula

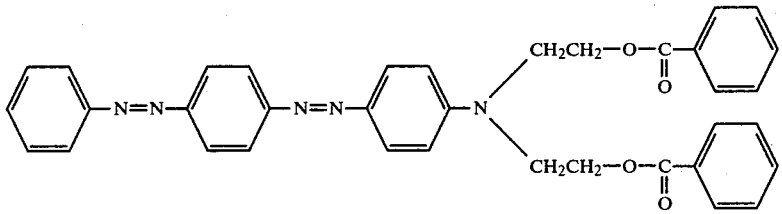

(commercial liquid form) and 6 g of a polymer of methacrylic acid having the molecular weight 1,000,000 and 100 g of a polyethylene glycol of the molecular weight 400.

The padded fabric (liquor pick-up 80%) is dried and heated to 210° C. for 1 minute on a condensation device.

An orange shade is obtained which has good fastness properties and a pleasant feel.

EXAMPLE 8

A knitted fabric that has been obtained from a mixed yarn of 50% of polyethyleneglycol terephthalate fibers and 50% of spun rayon fibers is printed with the following printing paste:

60 g of the dyestuff of the formula

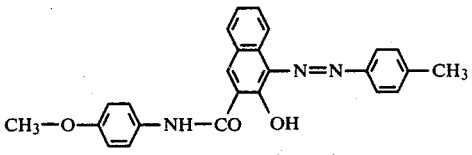

(commercial liquid form) are distributed in
820 g of a 2% aqueous ammonium polyacrylate solution (molecular weight 2,000,000) to which
120 g of an approximately 20 times oxethylated p-toluenesulfonamide are added.
1000 g The printed knitted fabric is dried and steamed with superheated steam at 185° C. during 6 minutes. A brilliant scarlet print is obtained having a good feel and satisfactory fastness properties.

EXAMPLE 9

A fabric consisting in wharp and weft of a mixed yarn whose components are 50% of cellulose triacetate fibers and 50% of cotton fibers is padded with a padding liquor (squeezing off effect 80%) which contains per liter 40 g of the dyestuff of the formula

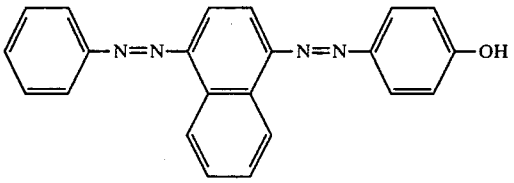

(commercial form) and 5 g of a copolymer of crotonic acid and maleic acid anhydride (molar ratio 2:1; molecular weight 1,000,000) and 100 g of an approximately 35 times oxethylated triethanolamine.

The dyeing is dried and heated to 200° C. for 1.5 minutes on the hot air setting stenter. An orange shade is obtained which has good fastness properties and a perfectly satisfactory feel.

EXAMPLE 10

A fabric consisting in wharp and weft of a mixed yarn whose components are 65% of polyethyleneglycol terephthalate fibers and 35% of cotton fibers is printed with a printing paste having the following composition:

60 g of the dyestuff of the formula

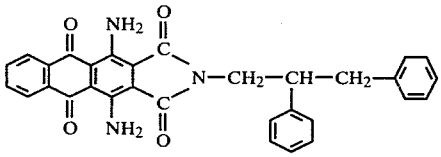

(commercial form) are introduced into 840 g of a 1% aqueous ammoniacal solution of a blend of a polymethacrylate having the molecular weight 3,000,000 and a copolymer of propylene and maleic acid anhydride (molar ratio 1:1; viscosity 100 P). To the solution 100 g of a polypropylene glycol of the molecular weight 1,000 are added.

1000 g

The printed fabric is dried and heated to 200° C. for 1 minute on the hot air setting stenter. After fixation, the print is rinsed cold and warm, treated with 1 g/l of an oxethylated alkyl phenol (having 12 ethylene oxide units) at 90° C. for 10 minutes, rinsed and dried.

A greenish blue print is obtained which has very good fastness properties.

We claim:

1. In a process for printing or pad-dyeing fabrics consisting of fibers of cellulose or regenerated cellulose or mixtures of these fibers with an aqueous composition containing a disperse dyestuff, the improvement which comprises printing or pad-dyeing said fabric with a printing paste or pad-dyeing liquor containing as a thickening agent a synthetic polymer which is an addition polymer containing recurring units of at least one low molecular weight ethylenically unsaturated mono- or dicarboxylic acid, said polymer having free carboxy groups.

2. In a process for printing or pad-dyeing a fabric made from a fiber blend containing at least 30% by weight of fibers consisting of cellulose, regenerated cellulose or mixtures of such fibers with an aqueous composition containing disperse dyestuffs, the improvement which comprises printing or pad-dyeing said fabric with a printing paste or pad-dyeing liquor containing as a thickening agent a synthetic polymer which is an addition polymer containing recurring units of at least one low molecular weight ethylenically unsaturated mono- or dicarboxylic acid, said polymer having free carboxy groups.

3. In a process for printing or pad-dyeing a fabric made of a fiber blend containing at least 30% by weight of fibers consisting of cellulose, regenerated cellulose or mixtures of such fibers and the remainder of said blend being synthetic fibers with aqueous compositions containing disperse dyestuffs, the improvement which comprises printing or pad-dyeing said fabric with a printing paste or pad-dyeing liquor containing as a thickening agent a synthetic polymer which is an addition polymer containing recurring units of at least one low molecular weight ethylenically unsaturated mono- or dicarboxylic acid, said polymer having free carboxy groups.

4. A process according to claim 3 wherein said synthetic fibers are polyester fibers.

5. A process according to claim 3 wherein said synthetic fibers are cellulose triacetate fibers.

6. A process as claimed in claim 3, wherein the thickening agent is dissolved or dispersed in water.

7. A process as claimed in claim 3, wherein said polymer contains recurring units of acrylic acid and its homologs, maleic or fumaric acid.

8. A process as claimed in claim 3, wherein said polymer contains recurring units of acrylic, methacrylic or crotonic acid.

9. A process as claimed in claim 3, wherein said polymer is a copolymer containing recurring units of ethylene, propylene or lower alkyl acrylate.

10. A process as claimed in claim 3, wherein the thickening agent is an alkali metal or ammonium salt of said polymer.

11. A process as claimed in claim 3, wherein the printing paste or padding liquor contains a compound of the formula $$R[(C_nH_{2n}O)_mH]_x$$

in which R is hydrogen, alkyl or alkenyl of up to 20 carbon atoms, phenyl, alkylphenyl with alkyl moieties of up to 10 carbon atoms, or R is a group of the formula

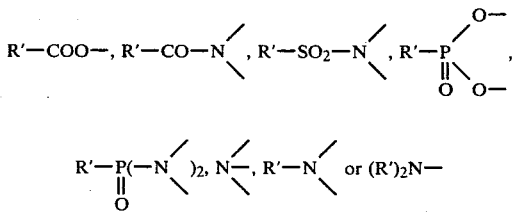

in which R′ is defined as R, n is 2 or 6, m is 1 to 40 and x is 1 to 3, with the proviso that the product of m and x is 4 to 40.

12. A process as claimed in claim 3 which comprises pad-dyeing or printing said material and fixing the disperse dyestuff by steaming with hot or pressurized steam or dry heat or a combination of these fixing procedures.

13. A process as claimed in claim 12, wherein steaming is performed for 10 to 30 minutes at 1 to 2.5 atmospheres gauge or for 30 seconds to 15 minutes with superheated steam of 150° to 220° C.

14. A process as claimed in claim 12, where fixing by dry heat is performed by exposure to hot air of 150° to 220° C., irradiation or contact heat.

* * * * *

UNITED STATES PATENT AND TRADEMARK OFFICE

CERTIFICATE OF CORRECTION

PATENT NO. : 4,231,745

DATED : November 4, 1980

INVENTOR(S) : Erich Feess et al.

It is certified that error appears in the above-identified patent and that said Letters Patent are hereby corrected as shown below:

In the Title, Item [54], and in Column 1, line 3, the word "MODIFIED" should be deleted.

In the Heading, Item [30], Foreign Application Priority Date, "Aug. 20, 1976" should read --Nov. 15, 1975--.

Signed and Sealed this

Sixth Day of January 1981

[SEAL]

Attest:

SIDNEY A. DIAMOND

Attesting Officer

Commissioner of Patents and Trademarks